United States Patent [19]

Braver

[11] 4,169,500

[45] Oct. 2, 1979

[54] MODULAR AIR CONDITIONING APPARATUS

[75] Inventor: Alvin S. Braver, Oklahoma City, Okla.

[73] Assignee: International Environmental Mfg. Co., Oklahoma City, Okla.

[21] Appl. No.: 932,274

[22] Filed: Aug. 9, 1978

Related U.S. Application Data

[63] Continuation-in-part of Ser. No. 684,454, May 7, 1976, Pat. No. 4,127,162.

[51] Int. Cl.[2] ..... F24F 3/08

[52] U.S. Cl. ..... 165/50; 165/65; 165/76

[58] Field of Search ..... 165/50, 22, 58, 27, 165/65, 64, 76

[56] References Cited

U.S. PATENT DOCUMENTS

| | | | |
|---|---|---|---|
| 2,798,366 | 7/1957 | Erl | 165/76 |
| 3,179,162 | 4/1965 | McFarlan | 165/50 |
| 3,251,540 | 5/1966 | Kinsworthy | 165/58 |
| 3,302,695 | 2/1967 | Payne | 165/27 |
| 3,411,569 | 11/1968 | Hildreth | 165/65 |
| 3,648,766 | 3/1972 | Whalen | 165/50 |
| 3,722,580 | 3/1973 | Braver | 165/50 |
| 3,731,056 | 5/1973 | Becker | 165/65 |
| 3,742,725 | 7/1973 | Berger | 165/76 |
| 4,019,570 | 4/1977 | Siegel | 165/76 |

*Primary Examiner*—Samuel Scott
*Assistant Examiner*—Daniel J. O'Connor
*Attorney, Agent, or Firm*—Dunlap, Codding & McCarthy

[57] ABSTRACT

An improved modular air conditioning apparatus featuring selective panel enclosures, plug-in controls, orientation selection and servicing capability for the simultaneous provision of air conditioning to a first room area and a second room area, the apparatus disposable between wall partitions or the like separating the first and second room areas. The apparatus comprises a frame assembly having a first open box frame and a second open box frame, each having three access sides. A blower and heat exchanger are disposed in an operating section of each of the open box frames, and these are removable through an access port provided by the removal of an intake grille disposed at one of the access sides on each of the open box frames. Riser pipes disposed in a vertical riser duct connect with other like units and supply hot or chilled water to heat exchangers. A plug-in control assembly senses an external temperature at each of the first and second room areas and controls the operation of the two blowers which draw air through the heat exchangers and blow air into a plenum section of each of the open box frames from which the air exits through an outlet grille disposed on each of the open box frames.

5 Claims, 6 Drawing Figures

MODULAR AIR CONDITIONING APPARATUS

CROSS REFERENCE TO RELATED APPLICATION

The present invention is a continuation-in-part of U.S. Patent Application No. 684,454, filed May 7, 1976, and now U.S. Pat. No. 4,127,162.

BACKGROUND OF INVENTION

1. Field of the Invention

The present invention relates generally to improvements in air conditioning apparatus, and more particularly but not by way of limitation, to modular air conditioning apparatus.

2. Description of the Prior Art

There are prior art teachings of heating and cooling units of the type utilizing a blower and heat exchanger arrangement for passing air over a coil through which a heated or chilled fluid heat transfer medium passes. Further, there are prior art teachings of such units receiving a heated or chilled fluid heat transfer medium from a central source recirculating unit. A common method is practiced whereby the air conditioning apparatus is located in close proximity to an air conditioned area, the air conditioning apparatus being permanently disposed between and generally hidden from view by the wall partitions of the area, as are the supply pipes for the recirculated fluid heat transfer medium. An example of such apparatus may be found in my patent, U.S. Pat. No. 3,722,580.

A problem with prior art air conditioning units involves the ability to service such units once the units have been installed. Such units often require the removal of a wall partition to gain access to the working components of the apparatus, and it is frequently necessary that the complete air conditioning apparatus be removed in order to make repairs or modifications.

SUMMARY OF THE INVENTION

The present invention contemplates an air conditioning apparatus of the type requiring a connection to a source of recirculated fluid heat transfer medium, the air conditioning apparatus being disposable between wall partitions or the like separating a first room area and a second room area, and comprising a frame assembly having a first open box frame associated with the first room area and a second open box frame associated with the second room area. Each of the first and second open box frames has three access sides. A first mid-panel member havng an opening therethrough is supported by the first open box frame to separate the first open box frame into an upper first plenum section and a lower first operating section; in like manner, a second mid-panel member having an opening therethrough is supported by the second open box frame to separate the second open box frame into an upper second plenum section and a lower second operating section. A first blower and a second blower are respectively supported by the first mid-panel member and the second mid-panel member and disposed to blow air from the operating sections through the openings in the mid-panel members into the plenum sections. A first heat exchanger is supported on the first open box frame in the first operating section and is positioned along a selected one of the three access sides of the first open box frame; in like manner, a second heat exchanger is supported on the second open box frame in the second operating section and positioned along a selected one of the three access sides of the second open box frame.

First and second control means are provided for sensing the temperature of the air in the first plenum area and the second room area respectively and for controlling the operation of the first blower and the second blower respectively in response thereto. A first outlet grille is supported by the first open box frame along one of the access sides and is disposed to direct air from the first plenum section to the first room area; in like manner, a second outlet grille is supported by the second open box frame along one of the access sides and disposed to direct air from the second plenum section to the second room area. A first intake grille is removably supported by the first open box frame and positionable at the selected access side thereof in intake air relationship to the first heat exchanger; in like manner, a second intake grille is removably supported by the second open box frame and is positionable at the selected access side in intake air relationship to the second heat exchanger Each of the first and second intake grilles defines an access port when removed from its respective access side.

Supply and return means provide fluid communication between the source for the heat transfer medium to and from the first and second heat exchangers, and a condensate drain means collects and disposes of condensate from the first and second heat exchangers. Electrical heaters may be provided to heat the air blown by the first and second blowers from the respective operating sections through the openings in the first and second mid-panel members into the plenum sections. Also, enclosure panels may be provided for enclosing the first and second open box frames along the two access sides of each that are not selected as the selected access sides for disposition of the first and second heat exchangers.

An object of the present invention is to provide an improved and more efficient air conditioning apparatus, the working components of which are accessible to facilitate servicing thereof.

Another object of the present invention is to provide an improved air conditioning apparatus that is disposable behind the wall partitions of a building in which is partially enclosed by such wall partitions.

Other objects, features and advantages of the present invention will be apparent from the following detailed description of presently preferred embodiments of the invention given for the purpose of disclosure when taken in conjunction with the accompanying drawings and appended claims.

BRIEF DESCRIPTION OF THE DRAWINGS

FIG. 6 is a semi-detailed top view of the apparatus of FIG. 1 having enclosure panels mounted on the non-selected access sides.

DESCRIPTION OF THE PREFERRED EMBODIMENT

The present invention relates to modular air conditioning units that are supplied with a flow through heat exchange medium from an external source. Such units are used in the construction of multi-story buildings, often referred to as high rise buildings. The term "air conditioning" as used herein, refers to the heating or cooling of air in a room area or the like to maintain the temperature of the air within a desired temperature range.

The present invention relates to an improved combination and arrangement whereby is provided modular air conditioning high rise units that give a wide range of versatility such that a field installer can order units that are best suited for a particular installation. As will become clear below, the modular units can be factory fitted so as to have enclosing panels affixed to the vertical sides of the open box frame, or the units can be left open for enclosing by the field application of approved, fire retardant building materials. In any event, once the modular units are installed, all of the working components can be easily serviced, a feature which is extremely important to the lifetime maintenance cost of a buiding. It will also be pointed out that the disclosed design offers other advantages, such as providing for a quiter operating unit.

After installation of a plurality of the improved air conditioning units of the present invention at a building site, the installed units are provided with flow through chilled water from a central chilling unit during an air cooling season, or with heated water from a central boiler during an air heating season. In some installations, it will be desirable to provide electrical heating and to provide chilled water to the units, thereby providing some simultaneous heating and cooling capability. Of course, it is also possible to achieve simultaneous heating and cooling capability by the provision of separate supply and return riser pipe pairs by the addition of independent heating and cooling coils in the heat exchanger unit.

Figure 1:
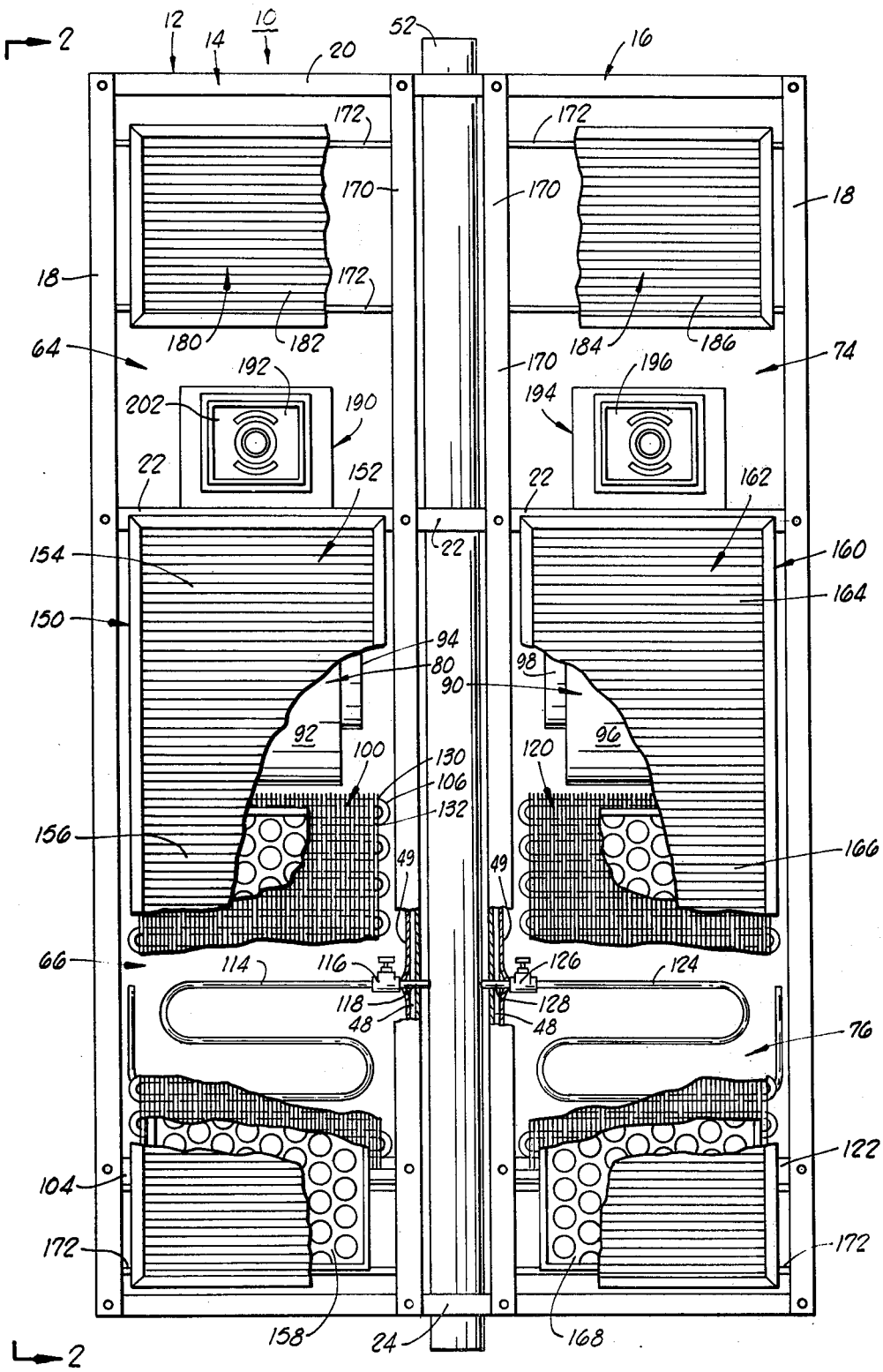
FIG. 1 is a side elevational view of an improved air conditioning apparatus constructed in accordance with the present invention and having partial cut-away portions to show the working components thereof.
Figure 2:
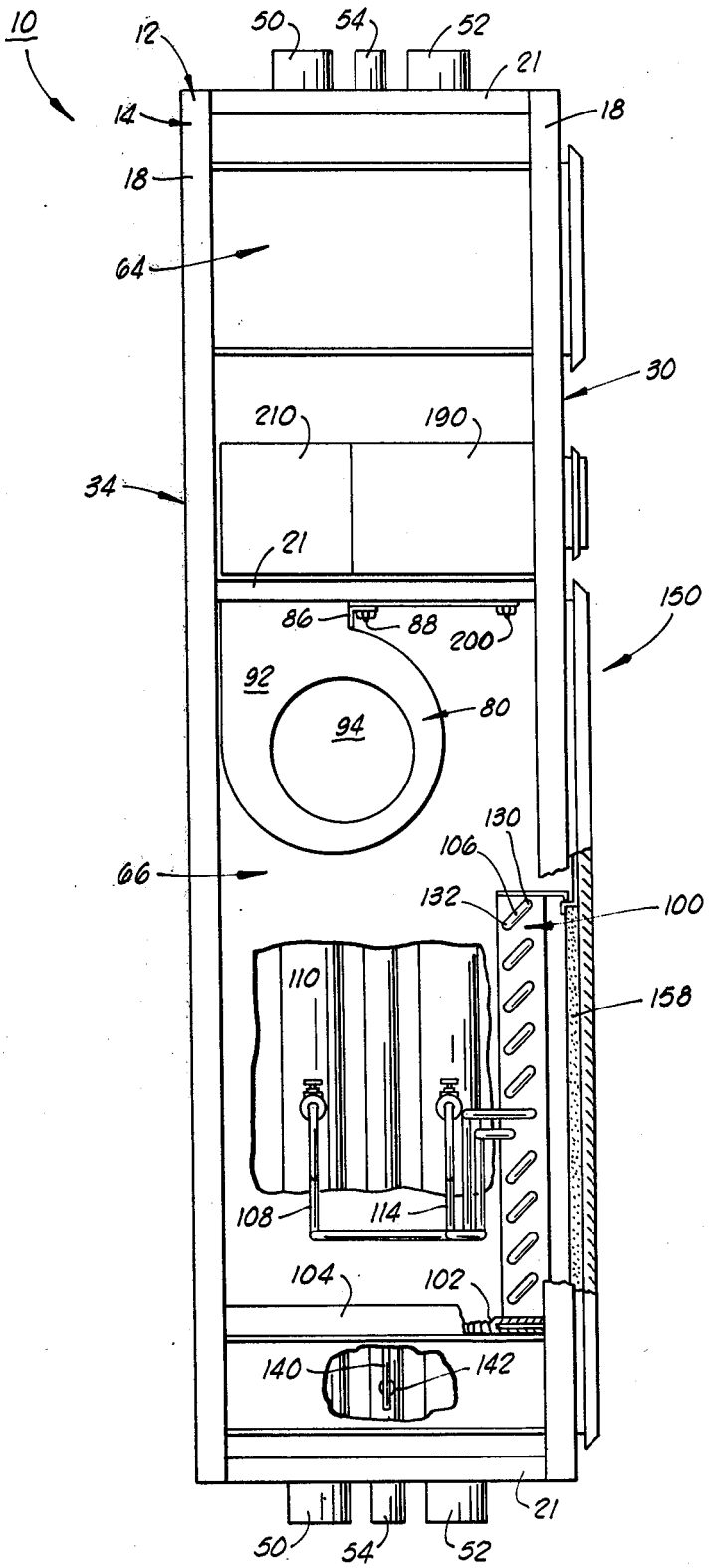
FIG. 2 is an elevational view of the end 2—2 of the air conditioning apparatus of FIG. 1 and having partial cut-away portions to show the working components and riser pipe connections.
Figure 3:
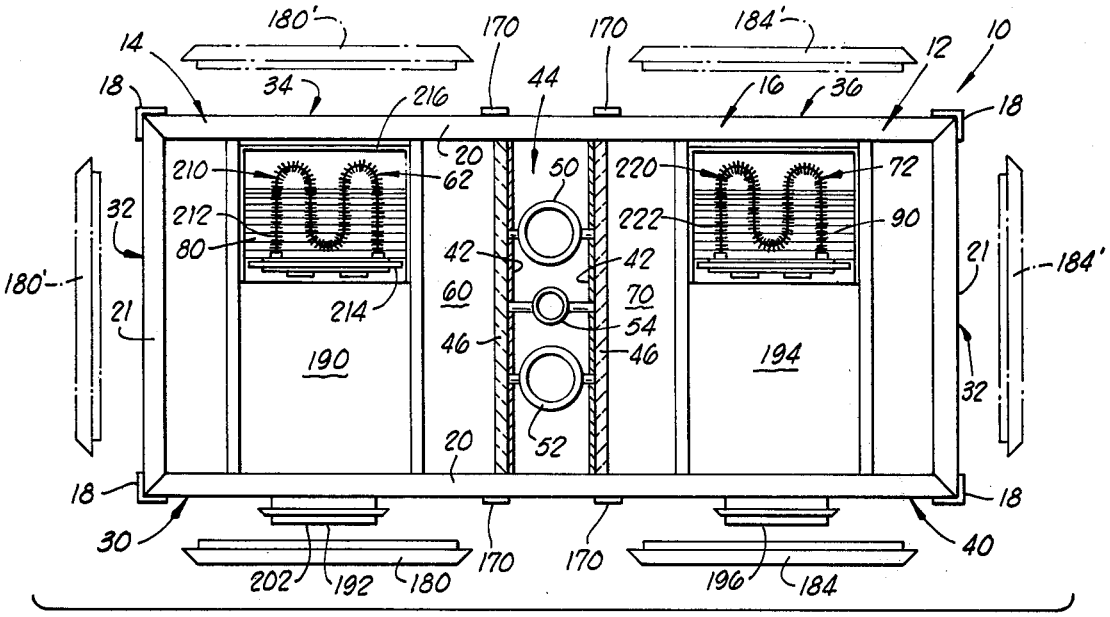
FIG. 3 is a top view of the apparatus shown in FIG. 1 with the top panel removed.

Referring to the drawings in general, and particularly to FIGS. 1 through 3, the air conditioning apparatus of the present invention is generally designated therein by the reference numeral 10. The air conditioning unit 10 comprises a frame assembly 12 that serves as the super structure to form the general outline of the air conditioning apparatus 10 and serves to support the working components thereof. The frame assembly 12 is comprised of a first open box frame 14 and a second open box frame 16. It is contemplated that the air conditioning apparatus 10 will be disposed between wall partitions or the like that separate a first room area and a second room area, and that the first open box frame 14 will be associated with the first room area so as to provide air conditioning therefor, and that the second open box frame 16 will be associated with the second room area to provide air conditioning therefor.

The frame assembly 12, and consequently the first and second open box frames 14, 16, are comprised of vertically disposed frame struts 18 that are held in spaced apart relationship by a number of cross braces 20, 22 and 24 that are connected thereto.

The first open box frame 14 is referred to herein as an open box frame because of the accessibility provided to the interior of the frame assembly 12 through the access planes defined by the vertical sides 30, 32 and 34 of the open box frame 14; the vertical access sides 30, 32 and 34 are also referred to herein as access sides. In like manner, the second open box frame 16 is also referred to by that terminology because it also provides accessibility to the interior of the frame assembly 12 via the access planes defined by the vertical sides 36, 38 and 40, which vertical sides are also referred to herein as access sides. Of course, the numbering of the access planes or sides is provided as a matter of convenience in description and it will be recognized that the access sides 30 and 40 are along a common side of the air conditioning apparatus 10, and the access sides 34 and 36 are along an opposite side of the air conditioning apparatus 10. It will be recognized from this description that the first open box frame 14 has three access sides: vertical sides 30, 32 and 24; and that the second open box frame 16 also has three access sides: vertical sides 36, 38 and 40.

The vertically disposed frame struts 18 along with the spaced apart cross braces 20, 22 and 24, are preferably made from galvanized steel angle iron stock because of the problem of condensation and the attendant corrosive problems encountered in air conditioning apparatus. Accordingly, it is advisable that the air conditioning apparatus 10 be constructed of corrosion resistant materials throughout.

As best shown in FIG. 3, a pair of verticaly disposed and generally parallel galvanized sheet metal panels 42 are connected to the frame assembly 12 to form a riser duct 44 disposed between the panels 42. A sheet of fire retardant insulation material 46 is adhered to one side of each of the sheet metal panels 42. The insulation material 46 may be one-half inch fiberglass bats and preferably are neoprene coated. As shown in FIG. 1, a clearance slot 48 is provided in each of the sheet metal panels 42 for pipes that extend into the riser duct 44, and a slotted neoprene foam rubber sheet 49 is provided at each of the slots 48 to partially seal these slots. The sheet metal panels 42 and the fire retardant insulation bats 44 serve to form a fire and sound barrier, and since these members are permanently attached to the frame assembly 12, accessibility to the working components of the air conditioning apparatus is thereby limited to the previously discussed access sides.

It should be noted that the air conditioning apparatus 10 has been shown in FIG. 3 with a slight deviation from the construction actually used. In practice, a sheet of metal is riveted to the cross struts 20 and 21 at the top of the frame assembly 12 to form a top panel member; however, this top panel member has not been shown in FIG. 3 in order to more clearly show the working components of the air conditioning apparatus 10. Preferably, this top panel is also insulated in a manner that insulation bats 44 have been described as attached to the sheet metal panels 46.

A supply riserpipe 50 and a return riser pipe 52 are vertically disposed in the riser duct 44 and fixably secured therein by attachment to the frame assembly 12. The attaching means utilized to secure the supply riserpipe 50 and return riser pipe 52 are not shown in the drawings, but it will be understood that conventional clamping means are utilized to establish the location of the riser pipes. In like manner, a condensate drain riser pipe 54 is also disposed in the riser duct 44 and is fixedly secured therein to be generally parallel to the riser pipes 50 and 52.

A square shaped first mid-panel 60, having an opening 62, is supported by the cross struts 22 and by connecting struts 21 near the middle of the open box frame 14, and separates the interior of the first open box frame 14 into an upper first plenum section 64 and a lower first operating section 66. The first mid-panel 60 has a square configuration for a reason that will be discussed below.

A square shaped second mid-panel 70 having an opening 72 is supported by the cross struts 22 near the middle of the second open box frame 16, thereby separating the interior of the second open box frame 16 into an upper second plenum section 74 and a lower second operating section 76. The second mid-panel 70 also has a square configuration for a reason that will be discussed below. The second mid-panel 70 is best viewed in FIG. 3, while the second plenum section 74 and the second operating section 76 are best viewed in FIG. 1.

Figure 4:
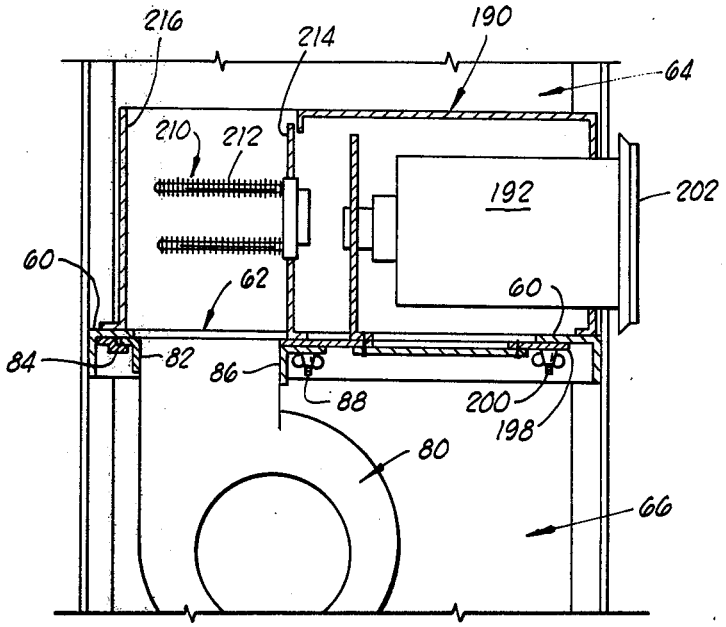
FIG. 4 is an enlarged and partial cut-away view taken at one end of the apparatus of FIG. 1 to show the electrical resistive heater and the electrical controls that control the blower.
Figure 5:
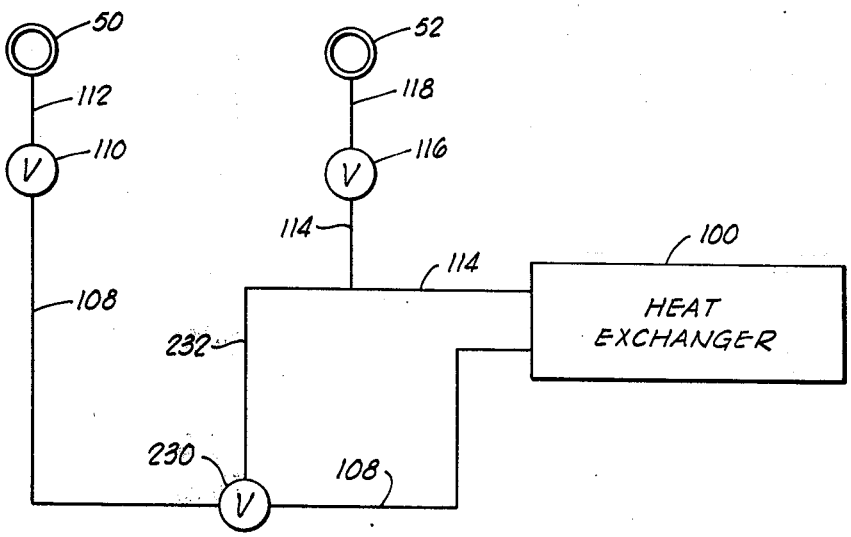

A motor driven blower 80 is supported by the first mid-panel 60 and is disposed in the first operating section 66 by means more clearly shown in the enlargement view of FIG. 4. The blower 80 has a longitudinal member 82 attached along one of its top edges that is engaged by a retaining member 84 attached to the underside of the first mid-panel 60 in the manner shown. Located in like manner to the longitudinal member 82 is the longitudinal member 86 attached along an opposite edge of the blower 80. Several threaded stud bolts 88 (one of which is shown having a wing nut retainer) extend from the first mid-panel 60 and securedly pass through apertures in the longitudinal member 86. This arrangement affords for the quick removal of the blower 80 from hanging engagement with the first mid-panel 60, and it also provides for easy replacement thereof with correct alignment being assured by the positive guiding action of the described connector arrangement.

In like manner, a motor driven blower 90 is supported by the second mid-panel 70 and is disposed in the second operating section 76 in the same manner as described above for the first motor driven blower 80. Since the connector arrangement for the second blower 90 is identical to that of the first blower 80, a detailed view and description will not be required for the purpose of the present disclosure.

The motor driven blowers 80 and 90 are centrifugal, direct drive type of blowers and function to draw air respectively from the operating sections 66 and 76 and to blow air respectively into the first plenum section 64 and into the second plenum section 74. Since each of the blowers is disposed in its respective operating section, each of the blowers 80 and 90 draw air through a heat exchanger which will be described hereinbelow. The blower 80 has a scroll blower unit 92 of conventional design and a driving motor 94. In like manner, the blower 90 has a scroll blower unit 96 of conventional design and a driving motor 98.

The electrical connections to the air conditioning apparatus 10 are not shown in the figures, as these are conventional and need not be discussed for purposes of this disclosure. It is suggested that the wiring to the blowers 80 and 90 be disposed in flexible conduits, and that slack loops be placed in the conduits so as to permit the removal of the blowers for inspection and repair without electrical disconnection.

Referring to the components of the first open box frame 14, the first mid-panel 60 is generally of a square shaped configuration so that it can be oriented in any of three different directions. That is, the first mid-panel 38 can be positioned with its opening 62 in close proximity to any one of the three access sides 30, 32 or 34 by simply turning the first mid-panel 60 accordingly and securing the first mid-panel 60 in the desired orientation relative to the access sides 30, 32 or 34. This arrangement permits the selective orientation of the working components supported by the first mid-panel 60 for a reason discussed hereinbelow.

In like manner, the second mid-panel 70 is also shaped generally in a square configuration so that it can be oriented in three different directions. That is, the second mid-panel 70 can be positioned with its opening 72 in close proximity to any one of the three access sides 36, 38 or 40 by simply turning the second mid-panel 70 accordingly and securing the second mid-panel 70 in the desired orientation relative to the selected access side 36, 38 or 40. As stated for the first mid-panel 60, this arrangement permits the selective orientation of the working component supported by the second mid-panel 70 for a reason discussed hereinbelow.

A first heat exchanger 100 supported by a base support 102, is disposed in the first operating section 66 and is positionable along one of the three access planes or sides 30, 32 or 34. A drain pan 104 is disposed in the lower portion of the second operating section 66 and supported therein by means connecting it to the frame struts 18. As shown in the partial cut away view of FIG. 2, the base support 102 rest in the bottom of the drain pan 104 and is secured thereto in any convenient manner such as by a bolt and lip arrangement. Although the first heat exchanger 100 is shown adjacent to the selected access plane or side 30 for purposes of illustration, it will be understood that the first heat exchanger 100 is readily disposable at either of the other access sides 32 and 34 as well.

The first heat exchanger 100 has a coil comprising a plurality of parallel, finned tubes 106 connected to provide for the passage of a heat exchange fluid medium through the first heat exchanger 100, which is conventional in heat exchanger art. One end of the coil of the first heat exchanger 100 is connected to the supply riser pipe 50 via a supply tube 108, a shut-off valve 110, and a stub nipple 112, which communicatingly connects to the supply riser pipe 50 and extends through the clearance slot 48 in the sheet metal panel 42 and the insulation bat 46. The neoprene sheet 49 is slotted and forms a partial seal about a stub 112. In practice, the riser pipes 50 and 52 are known to expand along their length, causing the stub nipple 112 to move generally in an upward or downward direction and the neoprene sheet 49 is slotted to provide a seal at any position of the stub nipple 112 as it moves with the movement of the riser pipe 52.

In like manner, a return tube 114 is connected to the other end of the coil of the first heat exchanger 100 and connects to the return riser pipe 50 via a combination shutoff and balancing valve 116 and a stub nipple 118 that communicatingly connects with the return riser pipe 52. In the illustration of the figures, the supply tube 108 and the return tube 114 serve to stabilize the first heat exchanger coil 100 in its vertical disposition. Additional support may be provided to the first heat exchanger 100 as required.

A second heat exchanger 120, similar in construction detail to the first heat exchanger 100 described above, is disposed in the second operating section 76 and is positionable along one of the three access sides 36, 38 or 40. A drain pan 122 is disposed in the lower portion of the second operating section 76 and is supported by the frame struts 18 in the same manner described above for the first heat exchanger 100. While the heat exchanger 120 is depicted as being adjacent to the selected access side 40 for purposes of this illustration, it will be understood that it is readily disposable at either of the other access sides 36 or 38 as well. Since the construction and connecting details of the second heat exchanger 120 are similar to and readily ascertainable from that for the first heat exchanger 100, it is sufficient for the purpose of this disclosure to simply note that the second heat exchanger 120 is connected to the riser pipes 50 and 52 via supply tubes, shut-off valves and stub nipples, and that of these only a supply tube 124, a shut-off valve 126, and a stub nipple 128 are viewable. As will be understood, the connections of the second heat exchanger 120 to the supply riser pipe 50 and to the return riser pipe 52 are similar to that described for the first heat exchanger 100.

With further detail to the construction of the first heat exchanger 100, it is noted that the tubes 106 of the first heat exchanger 100 form a double layer arrangement; that is, the coil comprising the tubes 106 passes in a transverse path across the first heat exchanger 100 so as to have a front layer 130 and back layer 132. This arrangement illustrates the benefit of placing the first heat exchanger 100 in the first operating section 66, as is true also for the second heat exchanger 120 disposed in the second operating section 76. That is, air is drawn across the first heat exchanger 100 at the low input pressure side of the blower 80 as opposed to the situation wherein a heat exchanger is placed downstream to a blower and consequently heats the high pressure output air of the blower. With the air drawing relationship of the blower 80 to the first heat exchanger 100 in the present invention, a larger space can be allocated to the heat exchanger, and more even air distribution over the heat exchanger coil can be acheived. That is, the velocity of air moving across the heat exchanger coil is more uniform over the entire area of the heat exchanger. This air draw-through relationship is also achieved for the second blower 90 and the second heat exchanger 120, and the same benefits are derived as that described for the air flow through the first heat exchanger 100.

Another advantage of placing the first and second heat exchangers 100, 120, respectively in the operating sections 66 and 76 is that the connecting tubes of the heat exchangers need not be insulated as would be the case if these connecting tubes were disposed in the plenum sections 64 and 74. The reason for this is that the connecting tubes are subjected only to the low pressure inlet air that passes through the first and second heat exchangers 100 and 120, and not to the expanding air from the blowers 80 and 90. It should also be noted that the connecting tubes are provided with expansion loops which is possible because of the greater space that can be alloted to the heat exchangers by virtue of the placement of the heat exchangers in the more spacious operating sections 66 and 76.

Each of the drain pans 104 and 122 has a centrally located drain aperture (not shown) to which is attached a drain tube 140 that is connected to the condensate drain riser pipe 54 by means of a flexible hose coupling stub nipple 142. Also, a slot and partial neoprene seal is provided in the manner described above for the stub nipples 112, 118.

Connected to the open box frame 14 adjacent to and in front of the first heat exchanger 100 is a first intake grille assembly 150 that is removably supported on the open box frame 14. The first intake grille assembly 150 comprises a louvered grille panel 152 that has a solid section 154 and an air passing section 156. The upper solid section 154 does not permit air passage, but the lower air passing section 156 permits air to pass through the grille panel 152 en route to the first heat exchanger 100. Disposed at the back side of the grille panel 152 is a filter 158 that filters the air passing through the grille panel 152. This filter is removably attached to the grille panel 152 so as to be removable for changing or cleaning as required.

A scond intake grille assembly 160, identical in construction detail to the first intake grille assembly 150, is supported by the open box frame 16 adjacent to and in front of the second heat exchanger 120. The second intake grille assembly 160, removably supported by the open box frame 16, comprises a louvered grille panel 162 that has a solid section 164 and an air passing section 166. As described above for the first intake grille assembly 150, the upper solid section 164 of the second intake grille assembly 160 does not permit air passage therethrough, but the lower air passing section 166 permits air to pass through the louvered grille panel 162 en route to the second heat exchanger 120. Also, disposed at the back side of the grille panel 162 is a removably attached filter 168 that filters air passing through the grille panel 152.

A vertically extending support strut 170 is connected to the cross struts 20, 22 and 24 and supports a horizontal grille support 172 located near the lower part of the open box frame 14 at each of the access sides 30 and 34. Similarly, another vertically extending support strut 170, also supported by the cross struts 20, 22 and 24, supports another horizontal grille support 172 located near the lower part of the open box frame 16 at each of the access sides 36 and 40. Each of the supports 172 also attaches to one of the vertical end frame struts 18. A similar strut 172 is supported by the appropriate frame struts 18 at the access sides 32 and 38. It has been found convenient to attach the grille assemblies 150 and 160 using resilient spring clips that press against the underside of the cross support 22 and against the top of the grille supports 82 located near the bottom of the first and second intake grille assemblies 150 and 160, as best shown in FIG. 1.

The first intake grille assembly 150 provides a route for return air to be received from the first room area by the air conditioning apparatus 10 while the second intake grille assembly 160 provides a route for return air received from the second room area. Both of the first and second intake grille assemblies 150 and 160 are sized so that when removed from the frame assembly 12, each of the intake grille assemblies 150 and 160 leaves an access port through which the respective heat exchangers 100 and 120, along with the motor driven blowers 80 and 90, can be serviced.

An outlet grille 180 having a louvered grille panel 182 is connected via spring clips or the like to a pair of upper grille support struts 172 that are in turn connected to the frame assembly 12 as described above. As shown in FIG. 3, the first outlet grille 180 is positionable at any one of the access planes 30, 32 or 34 (as depicted by the dashed outline of the first outlet grille 180'). A second outlet grille 184, having a louvered grille panel 186, is detachably supported by upper grille support struts 172 via spring clips or the like. As indicated, the second outlet grille 184 may be positioned at any one of the access planes or sides 36, 38 or 40 (as depicted by the dashed outline of the second outlet grille 190'). Of course, a plurality of outlet grilles 180 or 184 may be used with the air conditioning apparatus 10, and in installations using plural outlet grilles, there exists the possibility of light or sound traveling through outlet grilles serving the same plenum section. If this is objectionable, appropriately disposed baffles may be provided in the first and second plenum sections 64 and 74.

Disposed in the first and second plenum sections 64 and 74 are the electrical control systems that control the operation of the motor driven blowers 80 and 90. That is, in the first plenum section 64, a first plug-in control assembly 190 is supported by the first mid-panel 60 which is oriented in the figures to dispose the first control assembly 190 near the access plane 30. That is, the first control assembly 190 has a temperature sensor 192 that extends through the selected access plane 30, but it is understood that the positioning of the sensor 192 relative to the access sides 30, 32 or 34 is a choice of selection determined by the orientation of the first mid-panel 60. The first control assembly 190 is an electrical apparatus that controls the speed and operating times of the electric motor 94 of the blower unit 80 and comprises conventional temperature sensing and set point apparatus that need not be described further herein.

In like manner, disposed in the second plenum section 74 is a second plug-in control assembly 194 that has a temperature sensor 196, the second control assembly 194 being supported by the second mid-panel 70 so that the temperature sensor 196 extends through the selected access plane 40. Of course, the positioning of the sensor 196 relative to the access sides 36, 38 or 40 is selectively determined by the orientation of the second mid-panel 70. As was discussed for the first control assembly 190, the purpose of the second control assembly 194 is to provide electrical apparatus that controls the speed and operating times of the electric motor 98 of the blower unit 90 and also comprises conventional temperature sensing and set point apparatus.

It should be noted that both of the first and second control assemblies 190 and 194 are supported respectively by the first and second mid-panels 60 and 70 so that these units are unplugable by the reach of a repairman's arm reaching through the openings 62 and 72 located respectively in the first and second mid-panels 60 and 70. FIG. 4 shows the manner in which the first plug-in control assembly 192 is attached to the frame assembly 12, and is sufficient to illustrate also the manner in which the second control assembly 194 is so attached, since these two units are identically constructed. Referring to FIG. 4, a base plate 198 of the first control assembly 190 is attachable by appropriately located stud bolts 200 extending from the underside of the first mid-panel 60. The previously described stud bolt 88 serves to attach both the blower unit 80 and the first control assembly 190 to the first mid-panel 60. The temperature sensor 192 has a removable face plate 202 that is projected beyond the access plane 30. All electrical connections to the first control assembly 190 and to the first blower unit 80 are provided with mating plugs and receptacles so that these components may be easily removed from the apparatus 10.

The embodiment of the present invention that is illustrated in the accompanying figures is equipped with auxillary heaters that augment the operation of the heat exchangers previously described. Disposed in the first plenum section 64 is a first auxillary heater 210 that is comprised of a resistance wire coil 212 supported by a plate 214 that is one side of a box 216 supported by the first mid-panel 60 and which serves as an extension to the nozzle of the first blower unit 80 through which the air exiting from the first blower unit 80 must pass. The structure of the first auxillary heater 210 is conventional, and its inclusion herein is shown as an optional addition to the heating capability of the first heat exchanger 100. The appropriate electrical wiring necessary to operate the first heater 210 is not shown in the figures. While capable of being utilized as the sole heating means for the air conditioning apparatus 10 disposed in the first open box frame 14, the first heater 210 also enables the apparatus 10 to provide both heating and cooling capabilities to the first room area during the season of the year in which only cooling water is supplied to the apparatus 10 via the riser pipes 50 and 52. Additional riser pipes and heat exchanger coils may be provided to give concurrent heating and cooling capability, in which case the first heater 210 may not be necessary, or the first heater 210 may be provided as a back up unit in the event of difficulty with the hot water source.

In like manner, and for the same reasons advanced above for the first auxillary heater 210, a second auxillary heater 220 is disposed in the second plenum section 74 and is supported by the second mid-panel 70 so that the air from the second blower unit 90 is passed over a resistance wire coil 222. Since the construction detail of the second auxillary heater 220 is identical to that which has been described for the first auxillary heater 210, further description herein is unnecessary for the purposes of the present disclosure.

When the air conditioning apparatus 10 is provided with the heaters 210 and 220, some fire codes require that the first and second plenum sections 64 and 74 be enclosed by fire retardant material or by metal sheets. This is readily achievable, once the orientation of the working components is selected (such that the intake grille assemblies 150 and 160, etc., are each located at the selected access sides respectively 30, 32 or 34, or 36, 38 or 40), by welding, riveting, or otherwise attaching the enclosing material to the outside of the first and second open box frames 14 and 16, and to the tops thereof so as to enclose the first and second plenum sections 64 and 74. It should be noted that the enclosing of the plenum sections as described (not shown in the figures) does not impede the accessibility to the first and second operating sections 66 and 76, which is an important feature of the air conditioning apparatus of the present invention.

Figure 5:
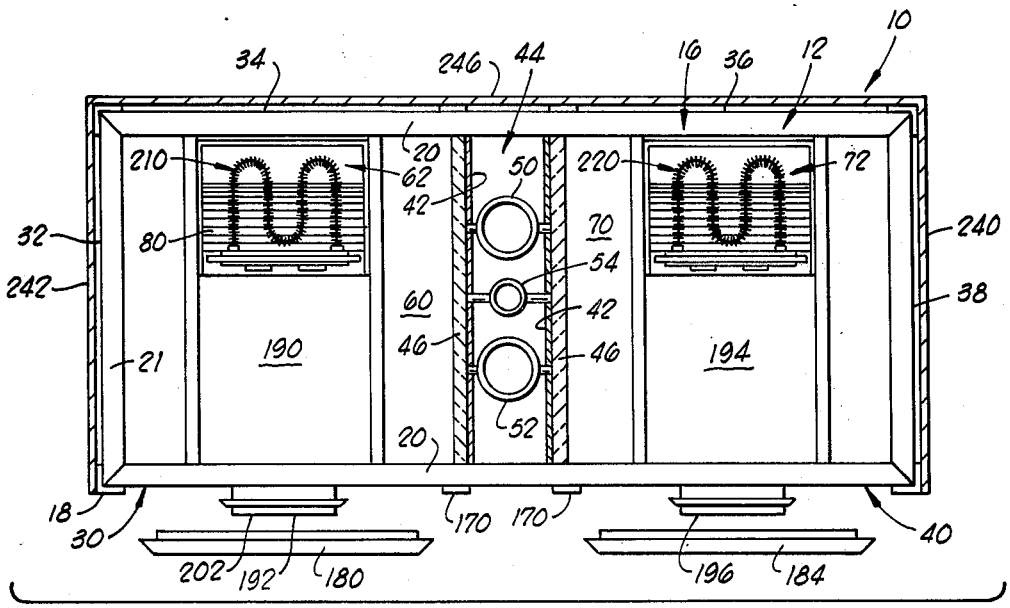
FIG. 5 shows a piping diagram depicting the electrically controlled three-way flow control valves in the apparatus of FIG. 1.

Also included in the preferred embodiment, but not shown in the other figures, is a valving arrangement such as depicted in FIG. 5. Since the plumbing connection of both of the heat exchangers 100 and 120 are identical, it will be understood that the schematic diagram provided in FIG. 5 which shows the plumbing hookup for the first heat exchanger 100 also is applicable to the second heat exchanger 120.

The apparatus 10 may be provided with an electrical control bypass valve 230 that is electrically controlled together with the blower unit 80 by the temperature sensor 192. (In the case of the second heat exchanger 120, it will be understood that another electrical control bypass valve is electrically controlled together with the second blower unit 90 by the temperature sensor 196). As shown in FIG. 5, one port of the three-way valve 230 is connected to the supply tube 108, and another port of the valve 230 is connected to a supply tube 108' that leads to the first heat exchanger 100. The third port of the three-way valve 230 is connected to a tube 232 that connects to the return tube 114. In operation, when the three-way valve 230 is energized with the first blower unit 80 to be in an operating mode, the valve 230 permits fluid communication between the supply tube 108 and the supply tube 108', and the valve 230 is closed to the tube 232. This operating mode allows normal operation of the first heat exchanger 100. On the other hand, when the first blower unit 80 and the electrically controlled three-way valve 230 are in a non-operate mode, the valve 230 permits fluid communication between the supply tube 108 and the tube 232, and the valve 230 prevents fluid communication to the supply tube 108'. In this non-operate mode, fluid supplied by the supply riser 50 passes through the supply tube 108 and the tube 232 to the tube 114 to return to the return riser 52 without passing through the first heat exchanger 100. Of course, a like description could be provided for the structure and operation of the valving of the second heat exchanger 120, but it is unnecessary in view of the above description for the identical valving arrangement for the first heat exchanger 100.

The sides of the frame assembly 12 that have not been selected for the disposition of the heat exchangers 100 and 120 can be enclosed as shown in the top plan view of FIG. 6 via a pair of end panels 240 and 242, and a side panel member 246. While a number of materials are suitable to serve as the construction material from which the enclosing panels 240, 242 and 246 are made, a fire retardant material is preferrable and will be required in some installations. Caulking material (not shown) may be used to seal the panels so that a pressure seal is formed between the plenum and operating sections of the first and second open box frames 14 and 16 as required.

Operation of the Preferred Embodiment

The air conditioning apparatus 10 may be conveniently installed between wall partitions that separate two adjacent room areas of a building structure. As discussed above, it is contemplated that the air conditioning apparatus will air condition a first room area and a second room area separated by the wall partitions. The air conditioning apparatus 10 has been designed in contemplation of such usage, and it is also contemplated that the frame assembly 12 may be enclosed on the job site by an approved material that is placed over the access sides 32, 34, 36, and 38, with material appropriately outlining the outlet grille panels 180, 190; the temperature sensor partitions 192, 196 of the first and second control assemblies 190, 194; and the first and second intake grille assemblies 150, 160. In the alternative, the first and second open box frames 14 and 16 may be provided enclosing panels at the factory location as described above.

The first and second open box frames 14 and 16 provide accessibility through selected access sides as discussed (in the illustrations herein, the access sides 30 and 40 have been selected), and the size of the intake grille assemblies 150 and 160 is predetermined so as to form access ports when detached from the apparatus 10 through which all of the working components of the apparatus 10 can be reached or removed as required for repair or replacement.

A plurality of riser pipes are vertically disposed for the purpose that the air conditioning apparatus 10 may be used as a stacked unit as taught in U.S. Pat. No. 3,722,580, mentioned above. For the purposes of this disclosure, a single supply riser pipe 50 and a single return riser pipe 52 have been shown. However, additional riser pipes may be provided as required, and additional heat exchanger coils may be added to the first and second heat exchangers 100 and 120, as required.

In operation, a heated or chilled fluid heat transfer medium is supplied to the air conditioning apparatus 10 through the supply riser pipe 50. The fluid heat transfer medium is supplied to the first and second heat exchangers 100 and 120 through the stub nipples 112 and 118 (FIG. 5), the shut-off valve 110 and the supply tube 108. The fluid heat transfer medium circulates through the first and second heat exchangers 100 and 120, to flow through the return tubes 114, the combination shut-off and balancing valves 116, 126 and the stub nipples 118, 128 to the return riser pipe 52 to return for reheating or rechilling. The valves 116, 126 serve as shut-off and balancing valves, these valves being opened as required to provide ample back pressure on the heat exchangers 100 and 120 to fill the coils thereof for maximum heat transfer.

Air from the first room air is drawn through the air passing section 156 of the first intake grille assembly 150 and passes through the filter 158, after which the air passes over the finned tubes of the first heat exchanger 100 and into the first operating section 66 via inducement by the motor driven blower unit 80. The blower 80 forces the air through the opening 62 in the first mid-panel 60 into the first plenum section 64 from which the air exits through the first grille 180 into the first room area being air conditioned. In like manner, air from the second room area being air conditioned is being drawn through the air passing section 166 of the second intake grille assembly 160 and through the filter 168, the air being drawn over the finned tubes of the second heat exchanger 120 into the second operating section 76 by the motor-driven blower 90. The blower 90 forces the air through the opening 72 in the second mid-panel member 70 into the second plenum section 74 from which the air exits through the second grille 184 into the second room area.

In order to cool the air in the respective room area being air conditioned, chilled heat transfer medium such as chilled water must be circulated through the first and second heat exchangers 100 and 120. As the air is drawn over the resultingly chilled surfaces of the finned tubes, heat is transferred from the air to the fluid heat transfer medium in the heat exchangers 100 and 120, thereby lowering the temperature of the air prior to its being blown into the respective plenum sections 64 and 74 and out through the respective outlet grilles 180 and 184. Conversely, in order to heat the respective room areas being air conditioned, a heated fluid heat transfer medium such as hot water is supplied to the first and second heat exchangers 100 and 120. As the air passes over the resultingly heated surfaces of the finned tubes, heat is transferred to the air from the fluid heat transfer medium thereby raising the temperature of the air prior to its passage into the respective plenum sections 64 and 74 and subsequently out of the respective outlet grilles 180 and 184 to the respective room areas.

The thermostat controls (the temperature sensors 192 and 196) sense the respective temperature of the air of the first and second room areas, and the first and second blowers 80 and 90 will be turned on or shut off according to these controls. The operation of the three-way valves 230 (FIG. 5) has been adequately discussed above, and it is sufficient to restate here that its purpose is to coordinate the flow of the heated or chilled water through the heat exchangers 100 and 120 with the controlled operation of the first and second blower units 80 and 90.

The operation of the electrical resistive heaters 210 and 220 is conventional, being energized respectively by the first and second control assemblies 190 and 194 in the manner above described, the blower operation being interlocked therewith to insure proper heat dissipation from the heaters.

To inspect or repair the working components of the air conditioning appratus 10, complete access to all of the working components is readily available by removal of the first and second intake grille assemblies 150 and 160 respectively, from the first and second open box frames 14 and 16. This provides access ports through which access to the interior of the frame assembly 12, and consequently the first and second open box frames 14 and 16, is provided. The first and second heat exchangers 100 and 120 may be removed after disconnecting the respective supply tubes 108 and return tubes 114 from the valves 110 and 116, 126. The first and second blower units 80 and 90 are easily removed from the respective first and second mid-panels 60 and 70 by removing the retaining wing nuts from the stud bolts 88 and by then pulling the blowers down and toward the access port provided by the removal of the first and second intake grille assemblies 150 and 160. Sufficient slack should be provided in the electrical connection to allow pulling the blowers 80 and 90 outside of the frame assembly 12. In like manner, the heaters 210 and 220 (if included) and the control assemblies 190 and 194 are readily removed (once the blowers 80 and 90 are removed) by removing the face plates thereof (which are usually press fitted on) and the retaining wing nuts from the stud bolts 200. This permits the lowering of the control assemblies 190 and 194 together with their respective heaters 210 and 220 through the respective openings 62, 72 of the mid-panels 60, 70, and the plug-in electrical connections permit quick disconnection of these components.

The first and second blower units 80 and 90, along with their respective motor units 94 and 98, are disposed in the first and second operating sections 66 and 76 in air drawing relationship to the respective heat exchangers 100 and 120. Because of their location, the motors 94 and 98 are constructed to produce less internal heat dissipation; that is, the motors 94 and 98 are permitted a smaller operating temperature rise (approximately 15° F.) over ambient temperatures, whereas motors normally are permitted up to about 70° rise above ambient. Suitable motors for the purpose of the present invention are manufactured by the General Electric Company as thermally protected, shaded pole Model 5KSP29BK, or as thermally protected split capacitor Model 5KCP29BK.

With the first and second blowers 80 and 90 disposed respectively in the more spacious first and second operating sections 66 and 76, a larger scroll blower construction can be used as opposed to the tightly wound scroll blower construction normally used when the blowers are located in the more tightly spaced plenum sections. Since a larger scroll construction can be used, less electrical power per unit of air move is experienced, and the first and second blowers 80 and 90 operate more quietly.

It is clear that the present invention is well adapted to carry out the objects and to attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

I claim:

1. An improved air conditioning apparatus of the type requiring connection to a source of heat transfer medium for providing simultaneous air conditioning to a first room area and to a second room area, the apparatus disposable between wall partitions or the like separating the first and second room areas and comprising:

a frame assembly comprising a first open box frame associated with the first room area and a second open box frame associated with the second room area, the first open box frame having three access sides and the second open box frame having three access sides;

a first mid-panel member having an opening therethrough and supported by the first open box frame so that the first mid-panel member separates the first open box frame into an upper first plenum section and a lower first operating section;

a second mid-panel member having an opening therethrough and supported by the second open box frame so that the second mid-panel member separates the second open box frame into an upper second plenum section and a lower second operating section;

a first blower supported by the first mid-panel member in the first operating section and disposed to blow air from the first operating section through the opening in the first mid-panel member into the first plenum section;

a second blower supported by the second mid-panel member in the second operating section and disposed to blow air from the second operating section through the opening in the second mid-panel member into the second plenum section;

a first heat exchanger supported on the first open box frame in the first operating section and positioned along a selected one of the access sides of the first open box frame;

a second heat exchanger supported on the second open box frame in the second operating section and positioned along a selected one of the access sides of the second open box frame;

first control means for sensing the temperature of the air in the first room area and for controlling the operation of the first blower in response thereto;

second control means for sensing the temperature of the air in the second room area and for controlling the operation of the second blower in response thereto;

a first outlet grille supported by the first open box frame along one of the access sides thereof and disposed to direct air from the first plenum section to the first room area;

a second outlet grille supported by the second open box frame along one of the access sides thereof and disposed to direct air from the second plenum section to the second room area;

a first intake grille removably supported by the first open box frame and positionable at the selected access side thereof in intake air relationship to the first heat exchanger, the first intake grille defining when removed an access port through which the first blower, the first heat exchanger and the first control means are selectively removable from the first operating section;

a second intake grille removably supported by the second open box frame and positionable at the selected access side thereof in intake air relationship to the second heat exchanger, the second intake grille defining when removed an access port through which the second blower, the second heat exchanger and the second control means are selectively removable from the second operating section;

supply means for providing fluid communication from the source of heat transfer medium to the first and second heat exchangers;

return means for providing fluid communication from the first and second heat exchangers to the source of heat transfer medium; and condensate drain means for collecting and disposing of condensate from the first and second heat exchangers.

2. The apparatus of claim 1 further comprising:

a first electrical heater supported by the first mid-panel member in the first plenum section and disposed in air heating relationship to the air blown by the first blower to the opening in the first mid-panel member; and a second electrical heater supported by the second mid-panel member in the second plenum section and disposed in air heating relationship to the air blown by the second blower through the opening in the second mid-panel member.

3. The apparatus of claim 1 or claim 2 further comprising:

first enclosure panels enclosing the first open box frame along the two access sides thereof that are not selected as the selected one of the three access sides along which the first heat exchanger is disposed; and second enclosure panels enclosing the second open box frame along the two access sides that are not selected as the selected one of the three access sides along which the second heat exchanger is disposed.

4. The apparatus of claim 1 wherein the supply means comprises a vertical supply riser pipe supported by the frame assembly and the return means comprises a vertical return riser pipe supported by the frame assembly.

5. The apparatus of claim 4 wherein the condensate drain means comprises:

a vertical condensate drain riser pipe supported by the frame assembly;

a first drain pan supported by the frame assembly below the first heat exchanger;

a first drain tube connecting the first drain pan and the condensate drain riser pipe;

a second drain pan supported by the frame assembly below the second heat exchanger; and a second drain tube connecting the second drain pipe and the condensate drain riser pipe.

* * * * *